US012202657B2

(12) United States Patent
Chen et al.

(10) Patent No.: US 12,202,657 B2
(45) Date of Patent: Jan. 21, 2025

(54) CRUSH-RESISTANT CARTON EMBEDDED WITH METAL SLAT

(71) Applicant: Rugao Sitong Color Printing Factory, Jiangsu (CN)

(72) Inventors: Jin Chen, Jiangsu (CN); Jianan Chen, Jiangsu (CN)

(73) Assignee: Rugao Sitong Color Printing Factory, Rugao (CN)

( * ) Notice: Subject to any disclaimer, the term of this patent is extended or adjusted under 35 U.S.C. 154(b) by 290 days.

(21) Appl. No.: 17/408,547

(22) Filed: Aug. 23, 2021

(65) Prior Publication Data

US 2023/0058357 A1 Feb. 23, 2023

(51) Int. Cl.

*B65D 5/44* (2006.01)
*B65D 5/50* (2006.01)
*B65D 63/10* (2006.01)

(52) U.S. Cl.

CPC ..... *B65D 5/448* (2013.01); *B65D 5/5035* (2013.01); *B65D 63/10* (2013.01)

(58) Field of Classification Search

CPC ..... B65D 5/448; B65D 5/5035; B65D 63/10; B65D 5/321; B65D 5/4283; B65D 5/503; B65D 5/68; B65D 21/064; B65D 5/446

USPC .... 229/199, 122.27, 122.32, 122.33, 122.34, 229/125.21, 199.1, 5.5, 5.7; 220/826; 53/485

See application file for complete search history.

(56) References Cited

U.S. PATENT DOCUMENTS

| | | | | |
|---|---|---|---|---|
| 3,709,358 | A * | 1/1973 | Andrews | B65D 71/0092 206/451 |
| 4,890,786 | A * | 1/1990 | Oberhofer | B65D 3/22 229/5.5 |
| 4,927,074 | A * | 5/1990 | LaRue | B65D 5/68 229/125.21 |
| 5,452,847 | A * | 9/1995 | Harris | B65D 5/66 16/373 |
| 5,531,374 | A * | 7/1996 | Gasper | B65D 5/3628 229/184 |
| 7,229,003 | B2 * | 6/2007 | Grigsby, Jr. | B65D 15/22 229/199 |
| 9,211,972 | B2 * | 12/2015 | Kizer | B65D 5/64 |
| 10,351,292 | B2 * | 7/2019 | Wishon | B65D 5/4204 |
| 10,710,786 | B2 * | 7/2020 | Porter | B65D 71/063 |
| 10,850,447 | B2 * | 12/2020 | Gasso | B65D 5/2052 |
| 11,007,716 | B2 * | 5/2021 | Gasso | B29C 64/307 |

FOREIGN PATENT DOCUMENTS

CN 213200401 U * 5/2021

* cited by examiner

*Primary Examiner* — Christopher R Demeree

(57) ABSTRACT

A crush-resistant carton embedded with a metal slat includes a box body and a plurality of strapping bands, all of the strapping bands is bound outside the box body, the box body includes an enclosure plate, two cover plates and a bottom backing plate; the two cover plates are respectively positioned at two ends of the enclosure plate in a height direction; each cover plate includes a main body plate and a plurality of side plates, all of the side plates are disposed around an outer periphery of the main body plate, and a plurality of pressure-resistant slats are respectively disposed on inner and outer sides of a corner portion formed by the main body plate and the side plates adjoined to each other; the bottom backing plate is disposed on an inner sidewall of the cover plate at a lower position.

6 Claims, 6 Drawing Sheets

CRUSH-RESISTANT CARTON EMBEDDED WITH METAL SLAT

STATEMENT REGARDING PRIOR DISCLOSURES BY AN INVENTOR OR JOINT INVENTOR

The contents of Chinese Patent Application Nos. 202021077933.8 filed on Jun. 11, 2020 and published on May 14, 2021 and 202021162279.0 filed on Jun. 19, 2020 and published on May 18, 2021, are grace period disclosures and shall not be prior art to claimed invention.

BACKGROUND

Technical Field

The present application relates to the field of packaging cartons, and more particularly, to a crush-resistant carton embedded with a metal slat.

Description of Related Art

Currently, a corrugated carton is a packaging product having a quite wide scope of application.

The following drawbacks exist in the existing carton: under the acting force of automatic mechanical packaging, the strapping band easily causes the phenomena of tightening marks and edge depression on the outer sidewall of a carton body, then the carton body is damaged, and materials loaded in the carton body are deformed and damaged.

SUMMARY

In order to alleviate the problem that the strapping band easily causes tightening marks and edge depression to the carton body, the present application provides a crush-resistant carton embedded with a metal slat.

The crush-resistant carton embedded with a metal slat according to the present application adopts the following technical solutions:

The crush-resistant carton embedded with a metal slat, including a box body and a plurality of strapping bands, all of the strapping bands being bound outside the box body, where the box body includes an enclosure plate, two cover plates and a bottom backing plate; the two cover plates are respectively positioned at two ends of the enclosure plate in a height direction; each cover plate includes a main body plate and a plurality of side plates, all of the side plates are disposed around an outer periphery of the main body plate, and a plurality of pressure-resistant slats are respectively disposed on inner and outer sides of a corner portion formed by the main body plate and the side plates adjoined to each other; the bottom backing plate is disposed on an inner sidewall of the cover plate at a lower position.

By adopting the above technical solutions, the automatic packaging mechanical equipment can bend the side plate according to the folding indentation, so that the box body used for packaging materials is rapidly formed, and this process does not increase the operation step or difficulty of the automatic packaging mechanical equipment. When the cover plate is formed, the longitudinal ends of the pressure-resistant slat on the side plates come into contact with each other to form a stable frame structure, which helps to ensure the stability of the forming quality of the cover plate and improve the pressure-resistant resistance of the cover plate. The bottom backing plate is used for bearing materials, and the manipulator can lift the backing plate up to a certain height to bear the materials; then, the bottom backing plate bearing the materials can be lowered into the cover plate at a lower position along with the manipulator, and then the two cover plates and the enclosure plate are enclosed and packaged. Meanwhile, the bottom backing plate supports the materials on the bottom wall of the box body, and can alleviate the vibration force between the materials and the box body, thereby ensuring the transportation stability and safety of the materials in the box body. The pressure-resistant slat effectively alleviates the phenomenon that the strapping band tightens the cover plate and causes tightening marks and edge depression when the strapping band is tightened, thereby guaranteeing the integrity of the box body, improving the supporting strength and edge pressure strength of the box body, and the integrity of the materials in the box body through its high pressure-resistance, deformation resistance and heavy pressure resistance.

In some embodiments, the pressure-resistant slat is a metal slat.

By adopting the above technical solutions, the metal slat can reduce the phenomenon of depression and tightening marks when the strapping band is tightened.

In some embodiments, the pressure-resistant slats are respectively positioned on two sides of the cover plate in the thickness direction.

By adopting the above technical solutions, after the pressure-resistant slats are simultaneously arranged on the sidewalls in the thickness direction of the cover plate, the overall pressure-resistant performance of the cover plate can be greatly improved, and the phenomenon of tightening marks and depression caused when the strapping band is tightened can be further reduced.

In some embodiments, the pressure-resistant slat is adhesively fixed to the cover plate.

By adopting the above technical solutions, the pressure-resistant slat is adhesively fixed to the cover plate, and the mounting is convenient and quick, thereby improving the production efficiency of the box body.

In some embodiments, the pressure-resistant slats positioned on the main body plates are arranged in end-to-end fashion to enclose a rectangular frame.

By adopting the above technical solutions, the longitudinal ends of the pressure-resistant slats together form a stable rectangular frame, which helps to improve the overall structural strength and support stability of the main body plates, and further improves the stability of the cover plates to bear materials.

In some embodiments, a reinforcement slat is provided on the cover plate at a lower position, the reinforcement slat is positioned on a sidewall of the side plate, and the reinforcement slat and the pressure-resistant slat positioned on the side plate are parallel to each other and spaced from each other.

By adopting the above technical solutions, the reinforcement slat is arranged on the cover plate at a lower position, so as to reinforce the structural strength of the cover plate, thereby reducing the phenomenon of deformation caused by overlarge bearing of the cover plate and reducing the phenomenon of tightening marks and depression caused by the tightening force of the strapping band at the bottom cover plate.

In some embodiments, the reinforcement slat is a metal slat.

By adopting the above technical solutions, the metal slat can reduce the phenomenon of depression and tightening marks occurring when the strapping band is tightened outside the box body, and the reinforcement slat provided on the cover plate at a lower position can further reduce the phenomenon of tightening marks and edge depression caused after the strapping band is tightened.

In some embodiments, the enclosure plate includes two abutment plates, and longitudinal ends of the two abutment plates abut against each other and are slidable relative to each other; the two abutment plates together form the enclosure plate.

By adopting the above technical solutions, two abutment plates together form the enclosure plate to serve as an outer frame of the box body. The two abutment plates can slide relative to each other to change the outer circumferential size of the box body, thereby reducing the phenomenon that the box body is damaged during packaging.

In some embodiments, plastic sealing films are respectively provided on the inner and outer sidewalls of the cover plate and the enclosure plate.

By adopting the above technical solutions, the plastic sealing film enables the sidewalls of the box body to have a certain waterproof and moisture resistance performance, thereby increasing the overall strength of the box body and the anti-mildew function.

In some embodiments, the bottom backing plate is completely covered with a heat shrink film.

By adopting the above technical solutions, the heat shrink film wraps around the outer periphery of the bottom backing plate, so that the bottom backing plate has a moisture resistance function, preventing the bottom backing plate itself or the surface of the bottom backing plate from mildewing by the bearer. Meanwhile, the heat shrink film helps to improve the strength of the bottom backing plate, and the sterilization effect can also be achieved by the high-temperature heat shrinkage process.

In summary, the present application includes at least one of the following beneficial technical effects:

1. the pressure-resistant slat is arranged at the contact position between the cover plate and the strapping band so as to bear the strapping band, thereby reducing the phenomenon of tightening marks and depression caused by the strapping band on the box body. The bottom backing plate is positioned in the inner chamber of the bottom backing plate, so as to improve the support stability of the bottom backing plate on the materials and play a role of shock relief.

2. The plastic sealing film covers the inner and outer sidewalls of the box body, and the heat shrink film completely wraps outside of the bottom backing plate, so that both the box body and the bottom backing plate have a certain waterproof and moisture resistance performance, thereby effectively ensuring application stability of the box body and the bottom backing plate, and transport stability and safety of materials in the box body.

DESCRIPTION OF THE EMBODIMENTS

Figure 1:
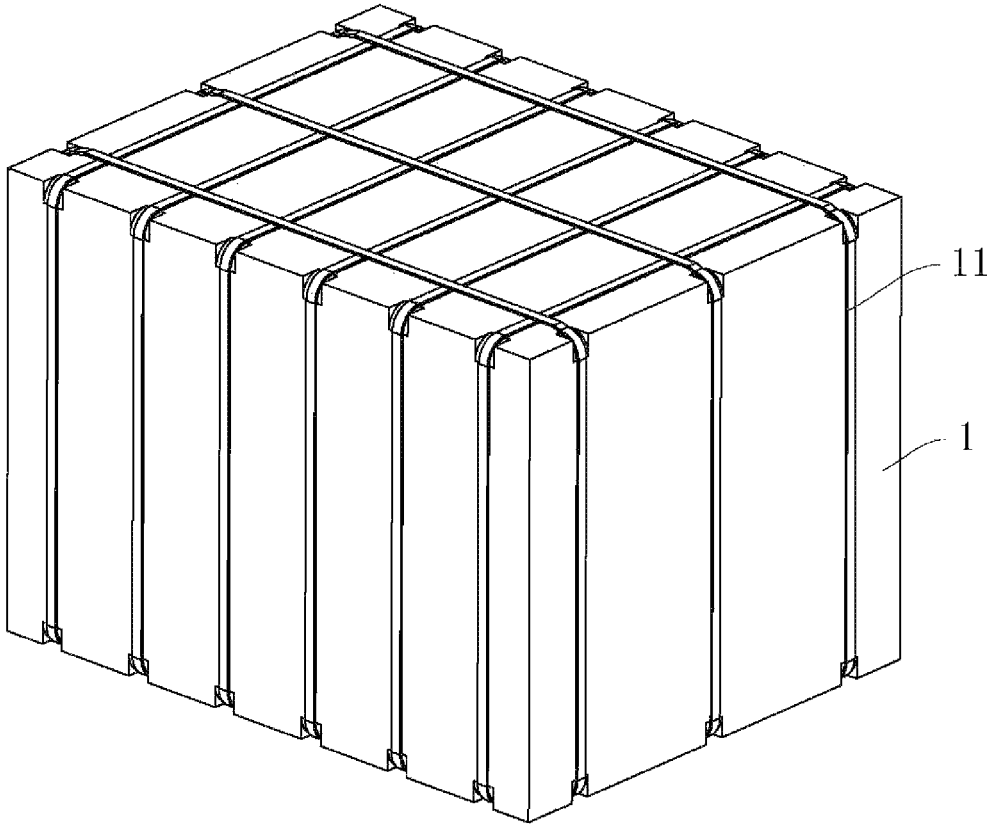
FIG. 1 is a schematic structural diagram of a carton in the related art.

Referring to FIG. 1, a carton is disclosed in the prior art, which includes a carton body 1 and a plurality of strapping bands 11. The inner chamber of the carton body 1 is used for loading materials, and the strapping band 11 is bound outside the carton body 1, so as to ensure the structural stability of the carton body 1.

This application is described in detail below with reference to FIGS. 2 to 6.

Figure 2:
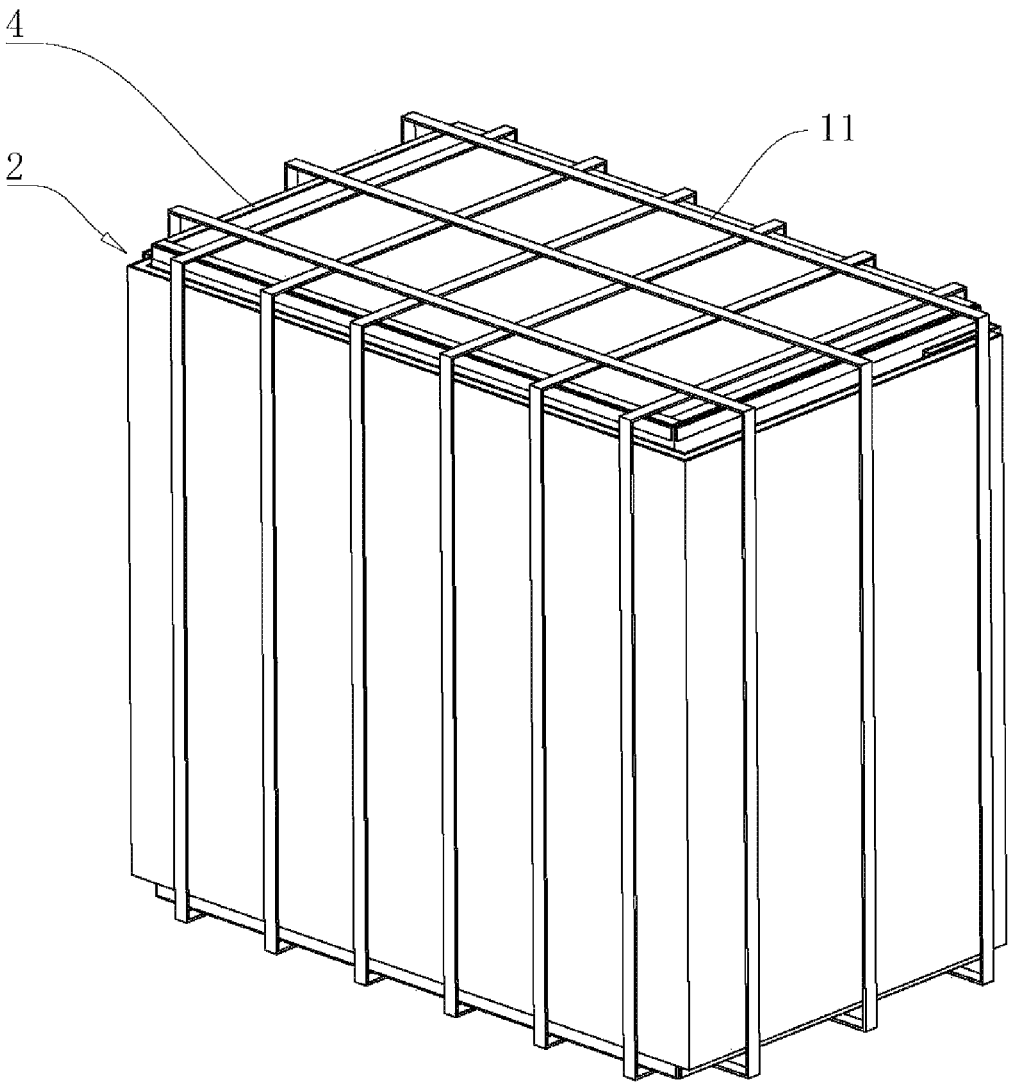
FIG. 2 is a structural schematic diagram of a crush-resistant carton embedded with a metal slat according to an embodiment of the present application.

Embodiments of the present application provide a crush-resistant carton embedded with a metal slat. Referring to FIG. 2, the crush-resistant carton embedded with a metal slat includes a box body 2 and a plurality of strapping bands 11. An inner chamber of the box body 2 is used for loading materials, and the strapping band 11 is used for binding the box body 2, so as to ensure structural stability of the box body 2 and transportation safety of materials through the box body 2.

Figure 3:
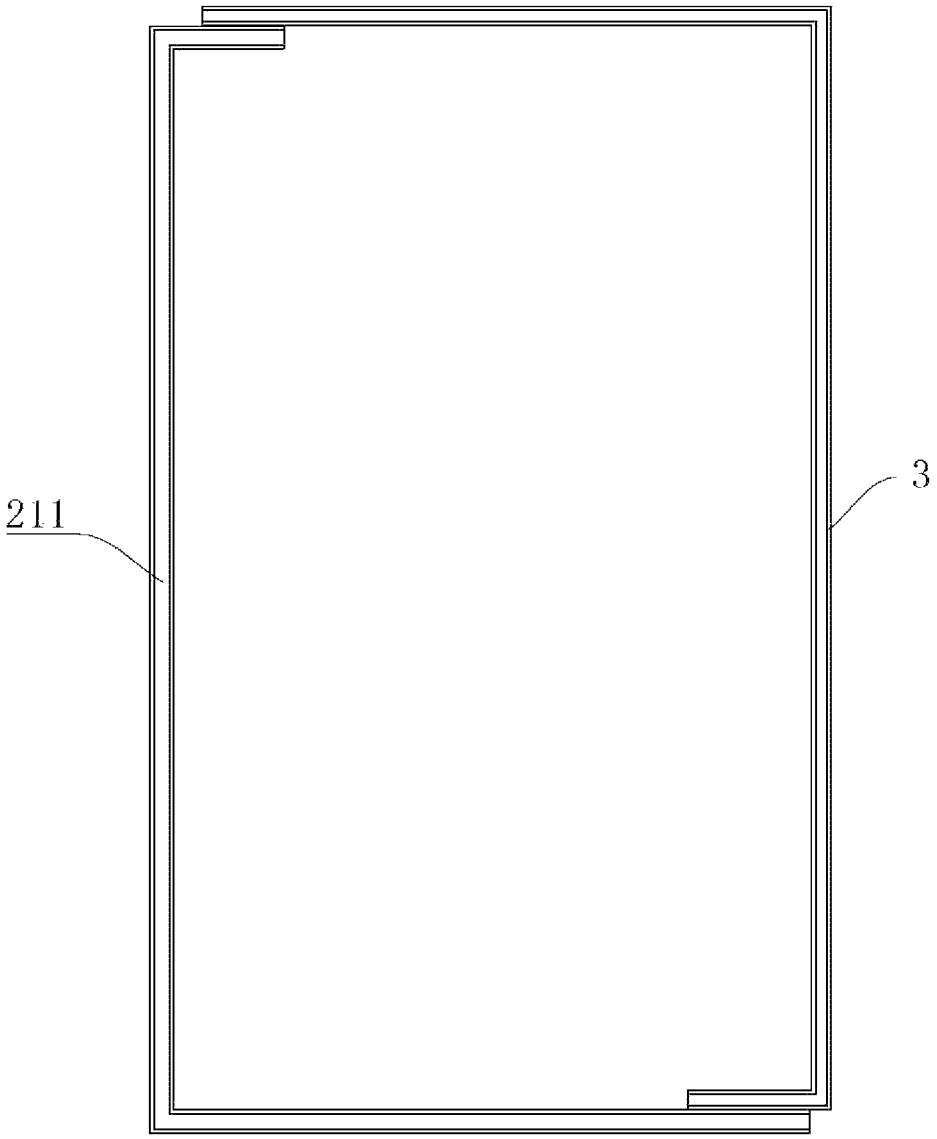
FIG. 3 is a schematic diagram of positional relationships between an enclosure plate and a plastic sealing film in the present application.
Figure 4:
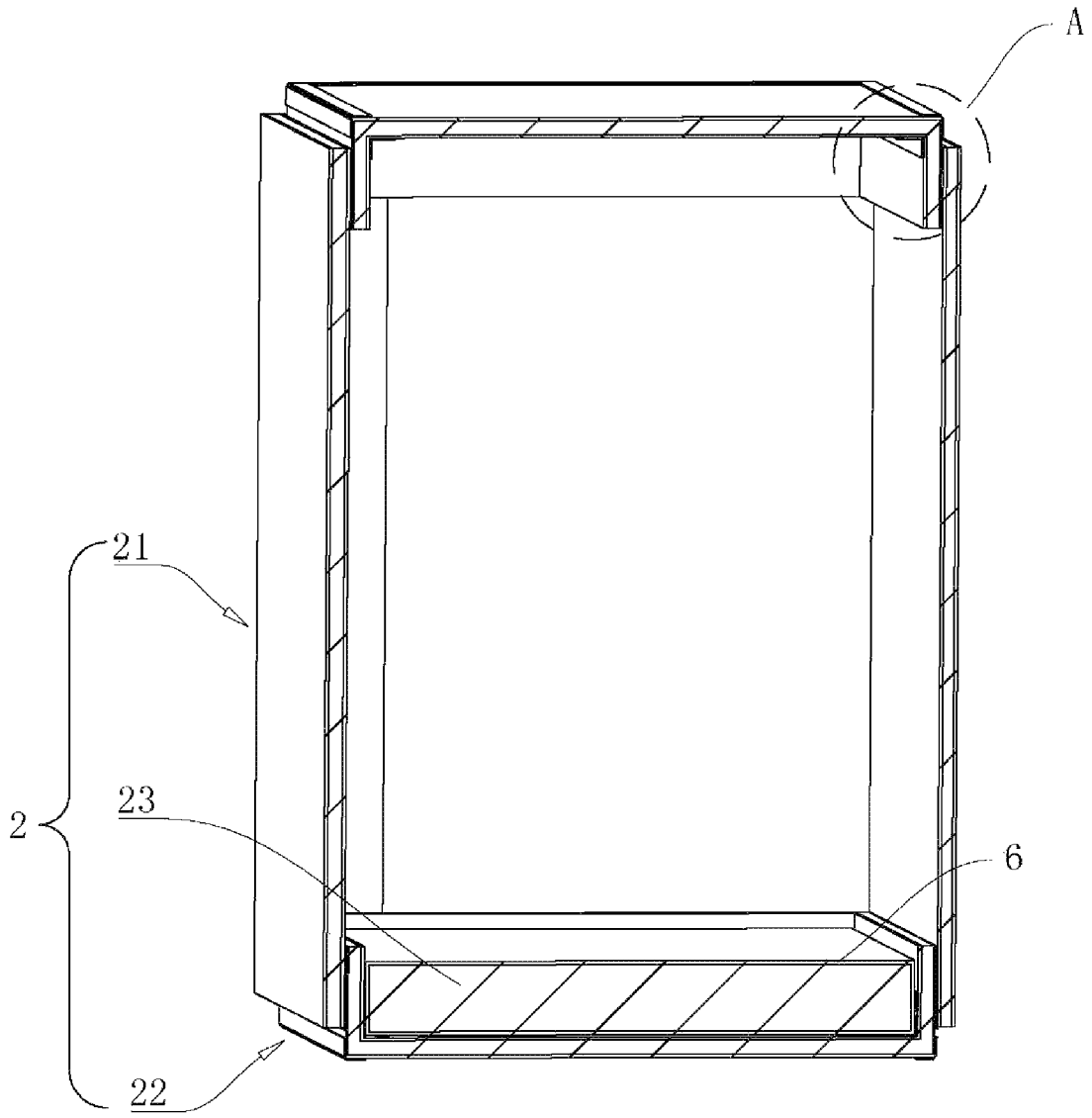
FIG. 4 is a longitudinal sectional view of positional relationship among an enclosure plate, a cover plate and a bottom backing plate in the present application.

Referring to FIGS. 3 and 4, the box body 2 includes an enclosure plate 21, two cover plates 22, and a bottom backing plate 23.

Figure 5:
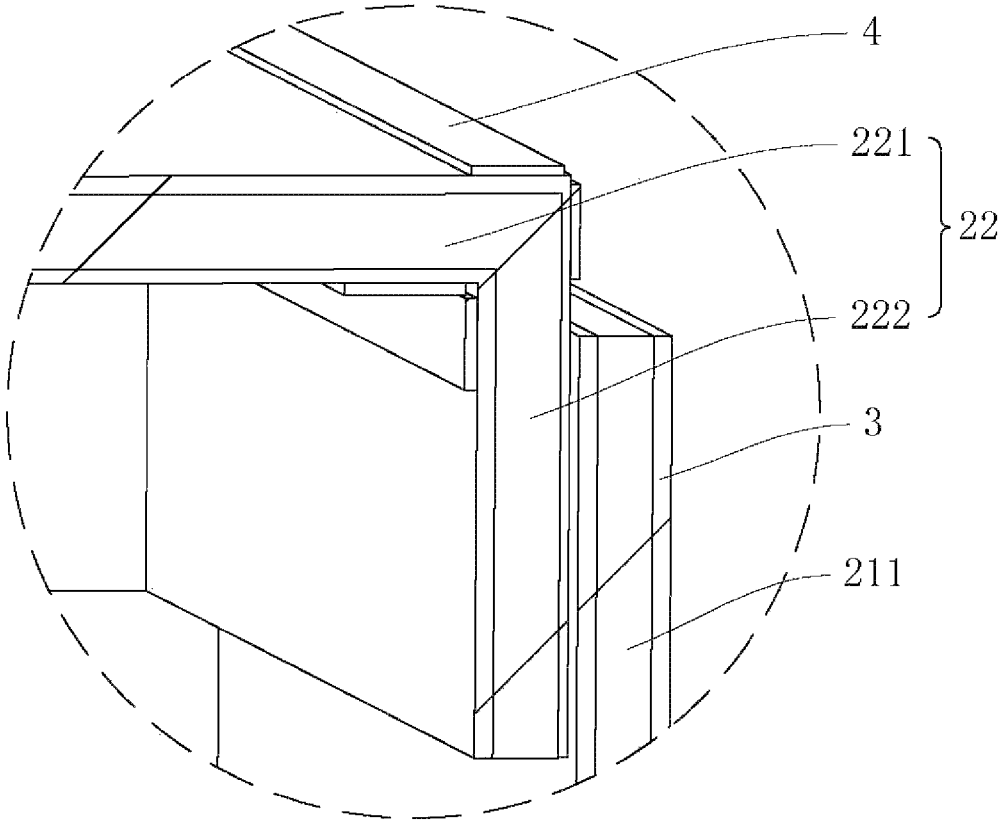
FIG. 5 is an enlarged schematic view of Portion A of FIG. 4 in the present application.

Referring to FIGS. 3 and 5, the enclosure plate 21 includes two abutment plates 211, and the abutment plate 211 is a corrugated paperboard having an L-shape at both longitudinal ends. Plastic sealing films 3 are respectively covered on both sides of the abutment plate 211 in the thickness direction, and the plastic sealing film 3 enables the enclosure plate 21 to have a waterproof and moisture resistance performance. The longitudinal ends of the two abutment plates 211 abut against each other to together form a rectangular enclosure plate 21, and the operator can slide two opposite abutment plates 211 to change the outer peripheral size of the enclosure plate 21, thereby reducing the phenomenon of damaging the box body 2.

Referring to FIGS. 4 and 5, the two cover plates 22 are respectively positioned at two ends of the enclosure plate 21 in the height direction, so as to package materials together with the enclosure plate 21. In this embodiment, the cover plate 22 positioned at the lower position is a bottom cover plate 22, which is used for supporting materials, and the cover plate 22 positioned at the higher position is a top cover plate 22. The cover plate 22 is a plate made of a plurality of layers of corrugated paperboard, and two sides of the cover plate 22 in the thickness direction are respectively covered with a plastic sealing film 3, so as to further improve the waterproof and moisture resistance performance of the box body 2.

Figure 6:
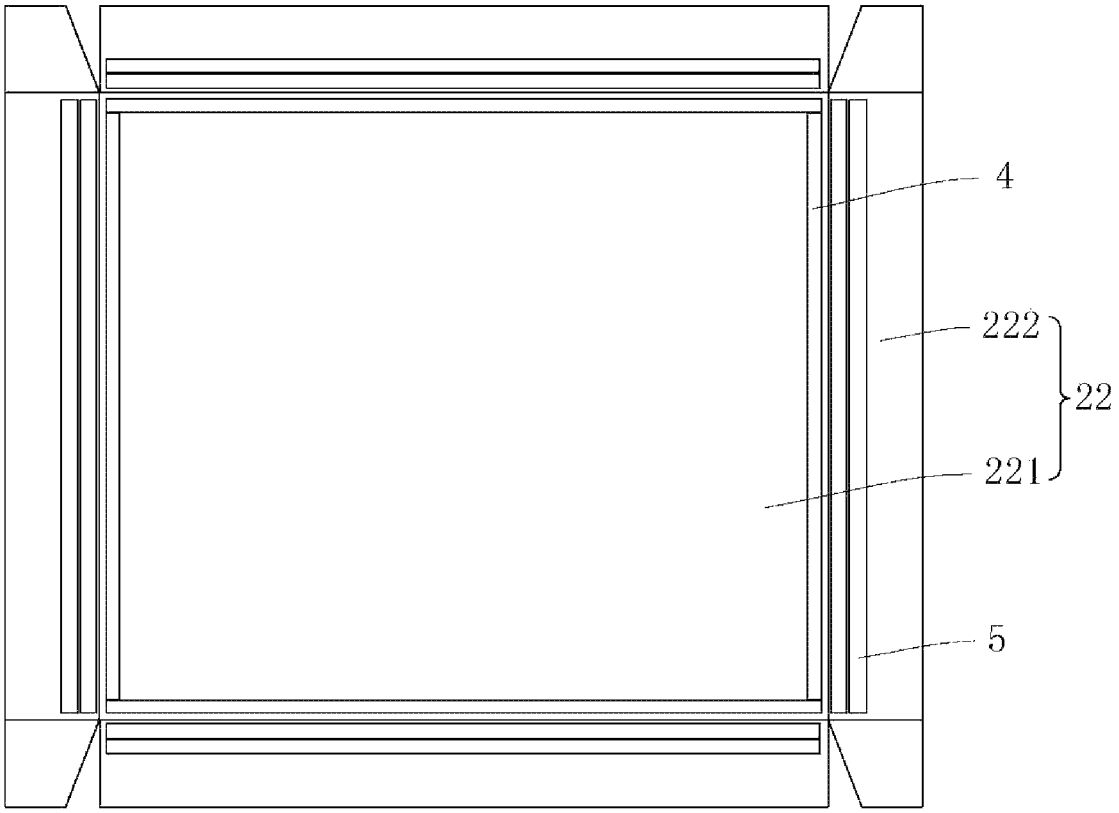
FIG. 6 is a schematic diagram of positional relationships among a main body plate, an abutment plate, a pressure-resistant slat and a reinforcement slat in the present application.

Referring to FIGS. 5 and 6, the cover plate 22 includes a main body plate 221 and a plurality of side plates 222. In this embodiment, the main body plate 221 is rectangular, and the number of side plates 222 may be four. The side plate 222 and the main body plate 221 are integrally formed, and the four side plates 222 are respectively positioned at the four sides of the main body plate 221 so as to together surround the outer periphery of the main body plate 221. When the cover plate 22 needs to be used, the automatic packing mechanical equipment may perform bending according to a preset folding indentation on the cover plate 22, so that the side plate 222 is perpendicular to the main body plate 221, and at this time, the cover plate 22 has a box structure for application.

Referring to FIGS. 5 and 6, two sides of each cover plate 22 in the thickness direction are respectively adhesively fixed with a plurality of pressure-resistant slats 4, and in this embodiment, the pressure-resistant slats 4 may be metal plates. The number of the pressure-resistant slats 4 on one side in the width direction of the main body plate 221 may be four, and the longitudinal ends of the four pressure-resistant slats 4 abut against each other to form a stable rectangular frame, and each of the pressure-resistant slats 4 is positioned on one side of the main body plate 221 close to the side plate 222.

Referring to FIG. 6, the number of pressure-resistant slats 4 positioned on one side in the width direction of the side plate 222 may be four, and the pressure-resistant slats 4 positioned on the side plate 222 and the pressure-resistant slats 4 positioned on the main body plate 221 are close to each other and parallel to each other. When the side plate 222 and the main body plate 221 are perpendicular to each other, the longitudinal ends of all the pressure-resistant slats 4 positioned on the side plate 222 are close to each other. Next, when the box body 2 is tightened by a strapping band, the longitudinal ends of all the pressure-resistant slat 4 positioned on the side plate 222 abut against each other, so that a plurality of stable rectangular frames are respectively enclosed on the inner side and the outer side of the sidewalls of the side plates 222 to support the strapping band 11, and the phenomenon that the strapping band 11 tightens the cover plate 22 and causes tightening marks is reduced.

Referring to FIG. 6, in this embodiment, a plurality of reinforcement slats 5 are adhesively fixed to the cover plate 22 at a lower position, and the reinforcement slats 5 are arranged on both sides of each side plate 222 in the width direction. The reinforcing slats 5 and pressure-resistant slats 4, which are adjacent to each other, are parallel to each other and are spaced apart from each other by a certain distance. When the strapping band 11 tightens the box body 2, the reinforcing slats 5 are arranged in an end-to-end fashion to form a stable rectangular frame, and at this time, a plurality of rectangular frames with stable structure are formed on the inner and outer sides of the sidewalls of the side edge plates 222, so as to further improve the crush-resistant performance of the cover plates 22.

Referring to FIG. 4, in this embodiment, the bottom backing plate 23 is a plate made of a multi-layer corrugated paperboard. The heat shrink film 6 is hot-pressed and molded on the outside the bottom backing plate 23, so as to improve the waterproof and moisture resistance performance of the bottom backing plate 23. The bottom backing plate 23 is positioned in the inner chamber of the carton and on the inside of the cover plate 22 at a lower position for bearing materials in the box body 2.

The implementation principle of a split pressure-resistant carton for resisting tightening marks and edge depression of a strapping band 11 in an embodiment of the present application is that the automatic packaging mechanical equipment can bend a side plate according to the folding indentation, so that the box body quickly forms a box-like structure, and this process does not increase the operation step and difficulty of the automatic packaging mechanical equipment, and helps to guarantee the stability of the shaping quality of the cover plate and guarantee the crush-resistance performance of the cover plate.

The bottom backing plate 23 is positioned in the inner chamber of the carton and on the inside of the cover plate 22 at a lower position for supporting the materials, and at the same time plays a role of shock relief. The pressure-resistant slat 4 and the reinforcement slat 5 simultaneously bear the strapping band 11 at both inner and outer sides of the cover plate 22, so as to reduce the phenomenon that the strapping band 11 tightens the cover plate 22 and causes tightening marks and depression on the outer sidewall of the cover plate 22, thereby reducing the phenomenon that the materials are pressed in the box body 2. The plastic sealing film 3 enables the box body 2 to have a certain waterproof and moisture resistance performance, and the heat shrink film 6 enables the bottom backing plate 23 to have a certain waterproof and moisture resistance performance, thereby improving the overall waterproof performance of the box body 2.

The above description is only preferred embodiments of the present application and is not intended to limit the protection scope of the present application. Therefore, all equivalent changes of the structure, shape or principle according to the spirit of the present application should be all included in the protection scope of the present application.

What is claimed is:

1. A crush-resistant carton, comprising a box body and a plurality of strapping bands, all of the strapping bands being bound outside the box body, wherein the box body comprises an enclosure plate, two cover plates and a bottom backing plate; the two cover plates are respectively positioned at two ends of the enclosure plate in a height direction; each cover plate comprises a main body plate and a plurality of side plates, all of the side plates are disposed around an outer periphery of the main body plate, and a plurality of pressure-resistant slats are respectively disposed on inner and outer sides of a corner portion formed by the main body plate and the side plates adjoined to each other; the bottom backing plate is disposed on an inner sidewall of the cover plate at a lower position, wherein the pressure-resistant slat is a metal slat;

wherein the pressure-resistant slats are respectively positioned on inner and outer sidewalls of the cover plate;

wherein the pressure-resistant slats positioned on the main body plates are arranged in end-to-end fashion to enclose a rectangular frame;

wherein the enclosure plate comprises two abutment plates, the abutment plates are a corrugated paperboard having an L-shaped at both longitudinal ends; and longitudinal ends of the two abutment plates abut against each other and are slidable relative to each other; the two abutment plates together form the enclosure plate.

2. The crush-resistant carton according to claim 1, wherein the pressure-resistant slat is adhesively fixed to the cover plate.

3. The crush-resistant carton according to claim 1, wherein a reinforcement slat is provided on the cover plate at the lower position, the reinforcement slat is positioned on a sidewall of the side plate, and the reinforcement slat and the pressure-resistant slat positioned on the side plate are parallel to each other and spaced from each other.

4. The crush-resistant carton according to claim 3, wherein the reinforcement slat is a metal slat.

5. The crush-resistant carton according to claim 1, wherein plastic sealing films are respectively provided on inner and outer sidewalls of the cover plate and the enclosure plate.

6. The crush-resistant carton according to claim 1, wherein the bottom backing plate is completely covered with a heat shrink film.

* * * * *